US009371624B2

(12) United States Patent
Suver et al.

(10) Patent No.: US 9,371,624 B2
(45) Date of Patent: Jun. 21, 2016

(54) ACCESSORY CONNECTION SYSTEMS AND METHODS FOR USE WITH HELICAL PILEDRIVING SYSTEMS

(71) Applicant: AMERICAN PILEDRIVING EQUIPMENT, INC, Kent, WA (US)

(72) Inventors: Paul Suver, Kent, WA (US); Dan Miller, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 66 days.

(21) Appl. No.: 14/321,632

(22) Filed: Jul. 1, 2014

(65) Prior Publication Data

US 2015/0016893 A1 Jan. 15, 2015

Related U.S. Application Data

(60) Provisional application No. 61/843,294, filed on Jul. 5, 2013.

(51) Int. Cl.
*E02D 7/22* (2006.01)
*E02D 5/56* (2006.01)

(52) U.S. Cl.
CPC ..... *E02D 7/22* (2013.01)

(58) Field of Classification Search
CPC ..... E02D 7/22; E02D 5/56; E02D 5/22; E21B 10/44; E21B 17/22
See application file for complete search history.

(56) References Cited

U.S. PATENT DOCUMENTS

| | | | |
|---|---|---|---|
| 5,015 | A | 3/1847 | Ingalls |
| 369,176 | A | 8/1887 | Gerstein |
| 628,962 | A | 7/1899 | Speer |
| 1,128,808 | A | 2/1915 | Manoogian |

(Continued)

FOREIGN PATENT DOCUMENTS

| | | | | |
|---|---|---|---|---|
| CA | 2452448 | A1 * | 6/2005 | ..... E02D 7/22 |
| CA | 2506382 | A1 * | 11/2006 | ..... E02D 7/22 |

(Continued)

OTHER PUBLICATIONS

A series of photographs identified by Reference Nos. APE01147-APE01159, 1990-1993, 13 pages.

(Continued)

*Primary Examiner* — James G Sayre
(74) *Attorney, Agent, or Firm* — Michael R. Schacht; Schacht Law Offices, Inc.

(57) ABSTRACT

An accessory mounting system a swivel assembly has a swivel member defining first and second swivel member connector portions, a swivel housing, and first and second bearings operatively arranged between the swivel member and the swivel housing. The accessory mounting system operatively connects a helical pile driving system having a rotational drive system and at least one clamp system to an accessory. The first swivel member connector portion is adapted to operatively connect the swivel member to the drive system. The second swivel member connector portion is adapted to operatively connect the swivel member to the accessory. The swivel housing is adapted to engage the at least one clamp system such that the clamp system may be operated to fix a position of the swivel housing relative to the drive system. The first and second bearings are configured to allow rotation of the swivel member relative to the swivel housing.

18 Claims, 15 Drawing Sheets

(56) References Cited

U.S. PATENT DOCUMENTS 1,213,800 A 1/1917 Piper
1,288,989 A 12/1918 Rees
1,322,470 A 11/1919 Schenk
1,343,902 A * 6/1920 Chapman ..... E21B 7/16 175/380
1,400,801 A 12/1921 Cohen
1,654,093 A 12/1927 Reid
1,702,349 A 2/1929 Krell
1,748,555 A 2/1930 Kinney
1,762,037 A 6/1930 Taylor
1,903,555 A 4/1933 Robertson
1,914,899 A 6/1933 Syme
1,988,173 A 1/1935 Kersting
2,068,045 A 1/1937 Wohlmeyer
2,126,933 A 8/1938 Stone et al.
2,350,921 A 6/1944 Pinazza
2,577,252 A 12/1951 Kjellman
2,809,014 A * 10/1957 Lawrence ..... E21B 10/44 173/164
2,842,972 A 7/1958 Houdart
2,859,628 A 11/1958 Arko
2,952,132 A 9/1960 Urban
3,094,007 A 6/1963 Luhrs
3,096,075 A 7/1963 Brown
3,100,382 A 8/1963 Muller
3,101,552 A 8/1963 Tandler et al.
3,115,198 A * 12/1963 Kuss ..... E02D 7/10 173/127
3,149,851 A 9/1964 Adams
3,172,485 A 3/1965 Spannhake et al.
3,177,029 A 4/1965 Larson
3,227,483 A 1/1966 Guild et al.
3,243,190 A 3/1966 Peregrine
3,289,774 A 12/1966 Bodine, Jr.
3,300,987 A 1/1967 Maeda
3,300,988 A * 1/1967 Phares ..... E02D 5/36 405/239
3,313,376 A 4/1967 Holland, Sr.
3,316,983 A * 5/1967 Goodman ..... E21B 11/005 173/147
3,371,727 A 3/1968 Belousov et al.
3,391,435 A 7/1968 Lebelle
3,394,766 A 7/1968 Lebelle
3,447,423 A 6/1969 Henry
3,450,398 A 6/1969 Barnes et al.
3,530,947 A 9/1970 Gendron
3,577,645 A 5/1971 Zurawski
3,620,137 A 11/1971 Prasse
3,672,032 A 6/1972 Witherspoon
3,684,037 A 8/1972 Bodine
3,686,877 A 8/1972 Bodin
3,711,161 A 1/1973 Proctor et al.
3,720,435 A 3/1973 Leyn
3,734,209 A 5/1973 Haisch et al.
3,786,874 A * 1/1974 Jodet ..... E21B 7/24 173/105
3,797,570 A 3/1974 Leutwyler
3,828,864 A 8/1974 Haverkamp et al.
3,854,418 A 12/1974 Bertin
3,861,664 A 1/1975 Durkee
3,871,617 A 3/1975 Majima
3,874,244 A 4/1975 Rasmussen et al.
3,891,186 A 6/1975 Thorsell
3,907,042 A 9/1975 Halwas et al.
3,952,796 A 4/1976 Larson
3,959,557 A 5/1976 Berry
3,998,063 A 12/1976 Harders
4,018,290 A 4/1977 Schmidt
4,067,369 A 1/1978 Harmon
4,082,361 A 4/1978 Lanfermann
4,099,387 A 7/1978 Frederick et al.
4,100,974 A 7/1978 Pepe
4,113,034 A 9/1978 Carlson
4,119,159 A 10/1978 Arentsen
4,143,985 A 3/1979 Axelsson et al.
4,144,939 A 3/1979 Knothe
4,155,600 A 5/1979 Lanfermann et al.
4,166,508 A 9/1979 van den Berg
4,180,047 A 12/1979 Bertelson
4,195,698 A 4/1980 Nakagawasai
4,248,550 A 2/1981 Blaschke et al.
4,285,405 A 8/1981 Weir, Jr.
4,308,924 A 1/1982 Boguth
4,312,413 A 1/1982 Loftis
4,375,927 A 3/1983 Kniep
4,380,918 A 4/1983 Killop
4,428,699 A 1/1984 Juhola
4,436,452 A 3/1984 Bodine
4,455,105 A 6/1984 Juhola
4,505,614 A 3/1985 Anschutz
4,537,527 A 8/1985 Juhola et al.
4,547,110 A 10/1985 Davidson
4,553,443 A 11/1985 Rossfelder et al.
4,567,952 A 2/1986 Lemaire et al.
4,601,615 A 7/1986 Cavalli
4,603,748 A 8/1986 Rossfelder et al.
4,627,768 A 12/1986 Thomas et al.
4,637,475 A * 1/1987 England ..... E21B 7/025 173/193
4,650,008 A 3/1987 Simson
4,687,026 A 8/1987 Westman
4,735,270 A 4/1988 Fenyvesi
4,755,080 A 7/1988 Cortlever et al.
4,757,809 A 7/1988 Koeneman et al.
4,758,148 A 7/1988 Jidell
4,813,814 A 3/1989 Shibuta et al.
4,819,740 A 4/1989 Warrington
4,863,312 A 9/1989 Cavalli
4,961,471 A 10/1990 Ovens
5,018,251 A 5/1991 Brown
5,076,090 A 12/1991 Cetnarowski
5,088,565 A 2/1992 Evarts
5,092,399 A 3/1992 Lang
5,117,925 A 6/1992 White
5,213,449 A 5/1993 Morris
5,263,544 A 11/1993 White
5,281,775 A 1/1994 Gremillion
5,343,002 A 8/1994 Gremillion
5,355,964 A 10/1994 White
5,375,897 A 12/1994 Gazel-Anthoine
5,385,218 A 1/1995 Migliori
5,388,652 A 2/1995 Smith
5,409,070 A 4/1995 Roussy
5,423,633 A 6/1995 Verstraeten
5,439,326 A 8/1995 Goughnour et al.
5,529,132 A 6/1996 Evarts
5,544,979 A 8/1996 White
5,549,168 A 8/1996 Sadler et al.
5,609,380 A 3/1997 White
5,653,556 A 8/1997 White
5,658,091 A 8/1997 Goughnour et al.
5,794,716 A 8/1998 White
5,811,741 A 9/1998 Coast et al.
5,836,205 A 11/1998 Meyer
5,918,511 A 7/1999 Sabbaghian et al.
6,039,508 A 3/2000 White
6,129,159 A 10/2000 Scott et al.
6,216,394 B1 4/2001 Fenelon
6,234,260 B1 5/2001 Coast et al.
6,360,829 B1 3/2002 Naber et al.
6,386,295 B1 5/2002 Suver
6,427,402 B1 8/2002 White
6,431,795 B2 8/2002 White
6,447,036 B1 9/2002 White
6,484,553 B1 11/2002 Devers
6,543,966 B2 4/2003 White
6,557,647 B2 5/2003 White
6,582,158 B1 6/2003 Van Stein
6,648,556 B1 11/2003 White
6,652,194 B2 11/2003 Ingle
6,672,805 B1 1/2004 White
6,691,797 B1 2/2004 Hart
6,732,483 B1 5/2004 White
6,736,218 B1 5/2004 White

(56) References Cited

U.S. PATENT DOCUMENTS

| | | | | |
|---|---|---|---|---|
| 6,752,043 | B2 | 6/2004 | Carlson | |
| 6,860,338 | B2 | 3/2005 | Salesse et al. | |
| 6,896,448 | B1 | 5/2005 | White | |
| 6,908,262 | B1 | 6/2005 | White | |
| 6,942,430 | B1 * | 9/2005 | Suver | E02D 5/56 405/232 |
| 6,988,564 | B2 | 1/2006 | White | |
| 7,043,806 | B2 | 5/2006 | Schrock et al. | |
| 7,168,890 | B1 | 1/2007 | Evarts | |
| 7,338,232 | B2 * | 3/2008 | Nasr | E02D 5/46 405/233 |
| 7,392,855 | B1 | 7/2008 | White | |
| 7,407,343 | B2 | 8/2008 | van Halteren et al. | |
| 7,694,747 | B1 | 4/2010 | White | |
| 7,708,499 | B1 | 5/2010 | Evarts et al. | |
| 7,824,132 | B1 * | 11/2010 | White | E02D 7/18 175/171 |
| 7,854,571 | B1 | 12/2010 | Evarts | |
| 7,950,876 | B2 * | 5/2011 | Suver | E02D 5/38 405/232 |
| 7,950,877 | B2 | 5/2011 | Evarts | |
| 8,070,391 | B2 | 12/2011 | White | |
| 8,181,713 | B2 | 5/2012 | White | |
| 8,186,452 | B1 | 5/2012 | White et al. | |
| 8,434,969 | B2 | 5/2013 | White | |
| 8,496,072 | B2 | 7/2013 | White | |
| 8,511,941 | B2 * | 8/2013 | Curic | E02D 5/36 175/19 |
| 8,763,719 | B2 | 7/2014 | White | |
| 2003/0089525 | A1 * | 5/2003 | Sherwood | E02D 5/36 175/57 |
| 2005/0000736 | A1 * | 1/2005 | Maki | E21B 7/002 175/394 |
| 2005/0013675 | A1 | 1/2005 | Bengston et al. | |
| 2005/0061550 | A1 * | 3/2005 | Harthauser | E02D 5/36 175/113 |
| 2005/0201836 | A1 * | 9/2005 | Suver | E02D 7/22 405/232 |
| 2006/0052818 | A1 | 3/2006 | Drake et al. | |
| 2006/0113456 | A1 | 6/2006 | Miller | |
| 2007/0110521 | A1 * | 5/2007 | Nimens | E02D 7/22 405/232 |
| 2008/0031695 | A1 * | 2/2008 | Nasr | E02D 5/46 405/233 |
| 2008/0310923 | A1 | 12/2008 | Jinnings et al. | |
| 2009/0290940 | A1 * | 11/2009 | Martin, Sr. | E02D 3/123 405/232 |
| 2010/0303552 | A1 | 12/2010 | Yingling et al. | |
| 2011/0091285 | A1 * | 4/2011 | Thurner | E02D 7/02 405/184.4 |
| 2011/0162859 | A1 | 7/2011 | White | |
| 2012/0255783 | A1 * | 10/2012 | Curtis | E21B 33/085 175/57 |
| 2012/0292062 | A1 | 11/2012 | White | |
| 2013/0149040 | A1 | 6/2013 | Evarts | |
| 2014/0294513 | A1 * | 10/2014 | Krinner | E02D 5/56 405/232 |

FOREIGN PATENT DOCUMENTS

| | | | | |
|---|---|---|---|---|
| DE | 4010357 | | 10/1990 | |
| DE | 102006053482 | | 6/2008 | |
| EP | 0172960 | | 5/1986 | |
| EP | 362158 | | 4/1990 | |
| EP | 526743 | | 10/1993 | |
| FR | 838717 | | 3/1939 | |
| FR | 2560247 | | 8/1985 | |
| GB | 2003769 | | 3/1979 | |
| GB | 2023496 | | 1/1980 | |
| GB | 2028902 | | 3/1980 | |
| GB | 2043755 | | 10/1980 | |
| GB | 2160566 | A * | 12/1985 | E02D 5/56 |
| GB | 2363133 | A * | 12/2001 | E02D 7/22 |
| IT | EP 0103283 | A2 * | 3/1984 | E02D 7/22 |
| JP | 61221416 | | 10/1986 | |
| JP | 5246681 | | 9/1993 | |
| JP | 6136751 | | 5/1994 | |
| JP | 2006028772 | A | 2/2006 | |
| NL | 42349 | | 1/1938 | |
| NL | 65252 | | 2/1950 | |
| NL | 7710385 | | 3/1978 | |
| NL | 7707303 | | 1/1979 | |
| NL | 7805153 | | 11/1979 | |
| RU | 26058 | U1 | 11/2002 | |
| SU | 1027357 | | 7/1983 | |
| WO | 8707673 | | 12/1987 | |
| WO | 8805843 | | 8/1988 | |

OTHER PUBLICATIONS

International Construction Equipment, Inc "Hydraulic Vibratory Driver/Extractors for Piling and Caisson Work," 10 pages.

International Construction Equipment, Inc "Hydraulic Vibratory Driver/Extractors for Piling and Caisson Work," Ref. No. V7-0890-51, 3 pages.

Japan Development Consultants, Inc., "Castle Board Drain Method" Japanese language brochure, Ref. Nos. APE00857-APE00863, Aug. 1976, 7 pages.

Korean language documents identified by Ref. Nos. APE00864-APE00891, dates from 1982-1997, 28 pages.

www.mmsonline.com/columns/micro-keying-keeps-a-better-grip.aspx, Seibert, Stan, Modern Machine Shop: "Micro-Keying Keeps a Better Grip," Aug. 1, 1992, 2 pages.

Report identifying systems for driving mandrels carrying wick drain material into the earth, Ref. Nos. APE0510-APE0536, 1994, 27 pages.

Schematic drawings, Ref. Nos. APE01038, APE01039, APE0339, 3 pages.

"The 1st Report on the Treatment of Soft Foundation in Juck Hyun Industrial Site", Ref. Nos. APE00854-APE00856, 1976, 3 pages.

ISA, ISR, PCT/US2014/045280, Nov. 6, 2014, 2 pages.

* cited by examiner

ACCESSORY CONNECTION SYSTEMS AND METHODS FOR USE WITH HELICAL PILEDRIVING SYSTEMS

RELATED APPLICATIONS

This application, U.S. patent application Ser. No. 14/321,632 filed Jul. 2, 2014 claims benefit of U.S. Provisional Application Ser. No. 61/843,294 filed Jul. 5, 2013, the contents of which are incorporated herein by reference.

TECHNICAL FIELD

The present invention relates to systems and methods for forming holes in the earth and, more particularly, to systems and methods for forming holes in the earth using a helical pile installation device.

BACKGROUND

Helical piles are elongate members having a helical blade at the lower end. The helical pile is supported upright with the helical blade adjacent to a desired insertion point and rotated such that the helical blade draws the helical pile into the earth at the desired insertion point.

In some situations, the conditions of the earth may prevent easy insertion of the helical pile using a standard helical pile driving system. In this case, another type of earthwork equipment must be procured and used to form a pilot hole or the like. Once the pilot hole has been formed, the standard helical pile driving system may be used to drive the helical pile in a conventional manner. The procurement of another type of earthwork equipment can result in delays on the jobsite.

The need thus exists for improved systems and methods for driving helical piles using standard helical pile driving systems.

SUMMARY

The present invention may be embodied as an accessory mounting system for operatively connecting a helical pile driving system comprising a rotational drive system and at least one clamp system to an accessory. The accessory mounting system comprises a swivel assembly comprising a swivel member defining first and second swivel member connector portions, a swivel housing, and first and second bearings operatively arranged between the swivel member and the swivel housing. The first swivel member connector portion is adapted to operatively connect the swivel member to the drive system. The second swivel member connector portion is adapted to operatively connect the swivel member to the accessory. The swivel housing is adapted to engage the at least one clamp system such that the clamp system may be operated to fix a position of the swivel housing relative to the drive system. The first and second bearings are configured to allow rotation of the swivel member relative to the swivel housing.

The present invention may also be embodied as a method of operatively connecting a helical pile driving system comprising a rotational drive system and at least one clamp system to an accessory. A method of the present invention may comprise the following steps. A swivel member defining first and second swivel member connector portions is provided. A swivel housing is provided. First and second bearings and provided. The first and second bearings are arranged between the swivel member and the swivel housing to allow rotation of the swivel member relative to the swivel housing. The swivel member is operatively connected to the drive system using the first swivel member connector portion. The swivel member is operatively connected to the accessory using the second swivel member connector portion. The clamp system is operated to fix a position of the swivel housing relative to the drive system by engaging the swivel housing with the at least one clamp system.

The present invention may also be embodied as a system for driving a helical pile comprising a rotational drive system adapted to drive the helical pile, at least one clamp system, at least one accessory, and a swivel assembly. The swivel assembly comprises a swivel member defining first and second swivel member connector portions, a swivel housing, and first and second bearings operatively arranged between the swivel member and the swivel housing. The first swivel member connector portion is adapted to operatively connect the swivel member to the drive system. The second swivel member connector portion is adapted to operatively connect the swivel member to the at least one accessory. The swivel housing is adapted to engage the at least one clamp system such that the clamp system may be operated to fix a position of the swivel housing relative to the drive system. The first and second bearings are configured to allow rotation of the swivel member relative to the swivel housing.

DETAILED DESCRIPTION

Figure 1A:
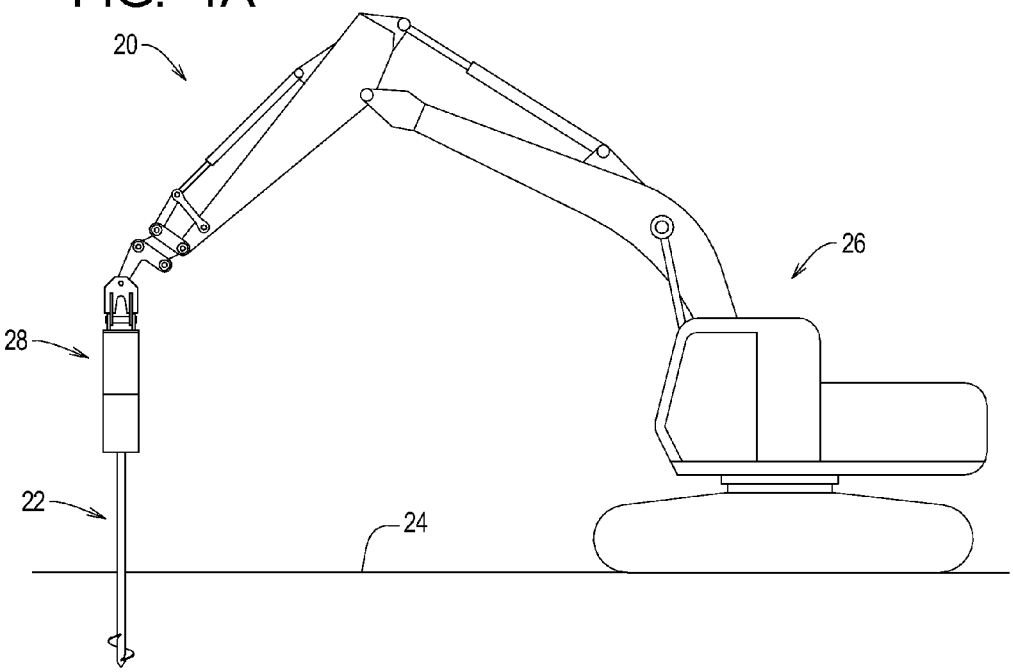
FIG. 1A is a side elevation view of an example drive system for helical piles driving an example helical pile.
Figure 3A:
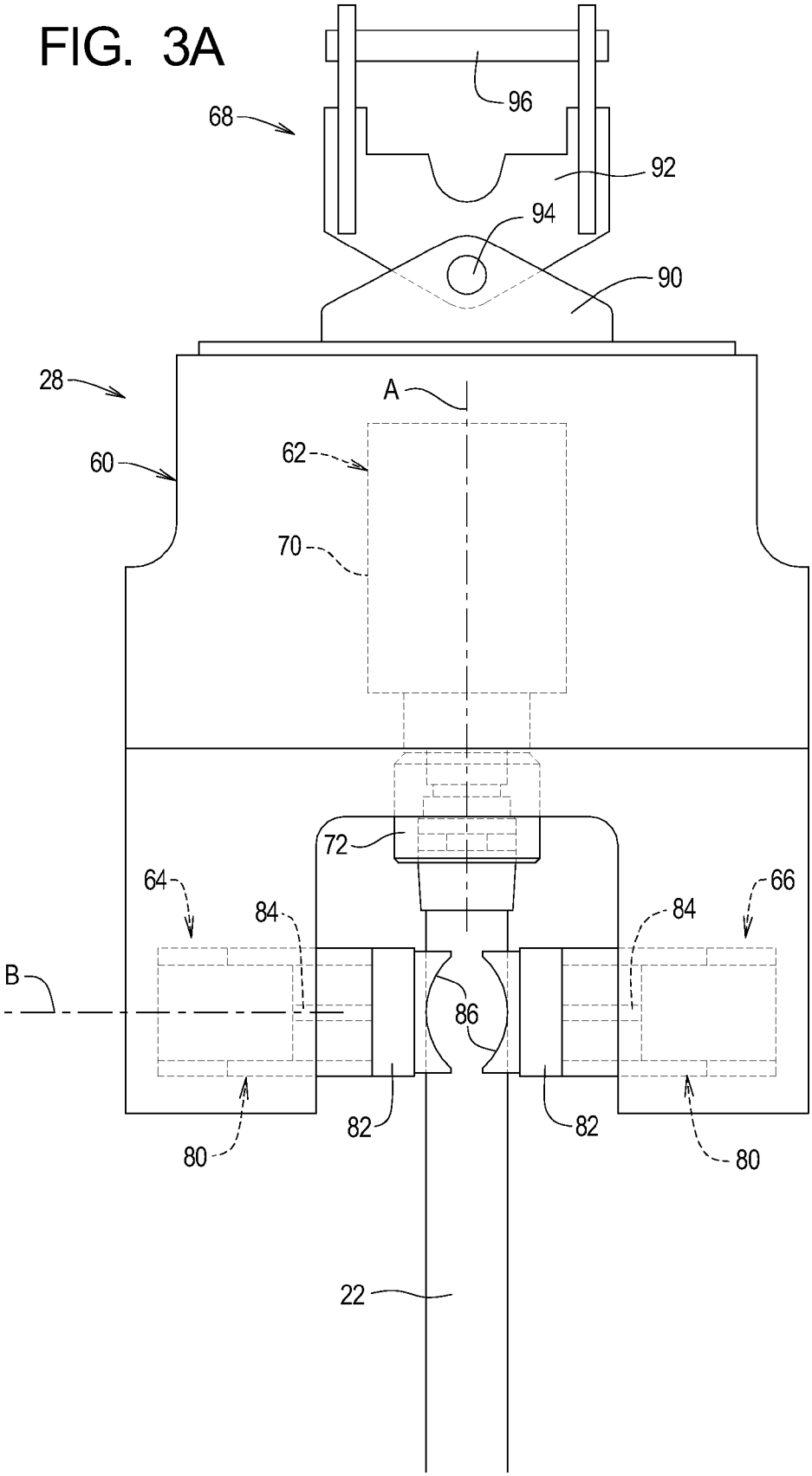
FIG. 3A is a front elevation view of a rotational drive system connected to the helical pile, with the rotational drive system being depicted in a clamped configuration.
Figure 3B:
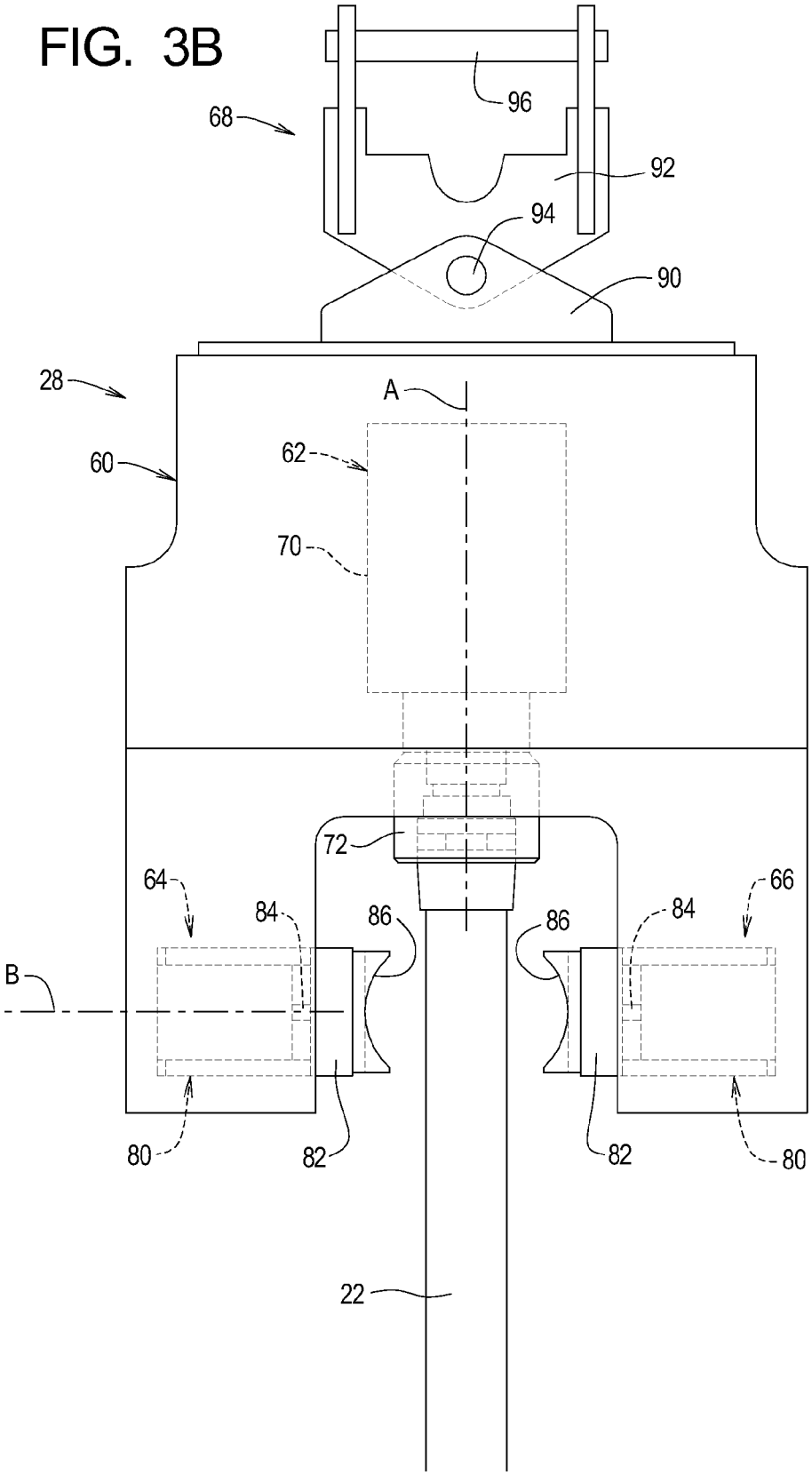
FIG. 3B is a front elevation view of a rotational drive system connected to the helical pile, with the rotational drive system being depicted in an unclamped configuration.
Figure 4A:
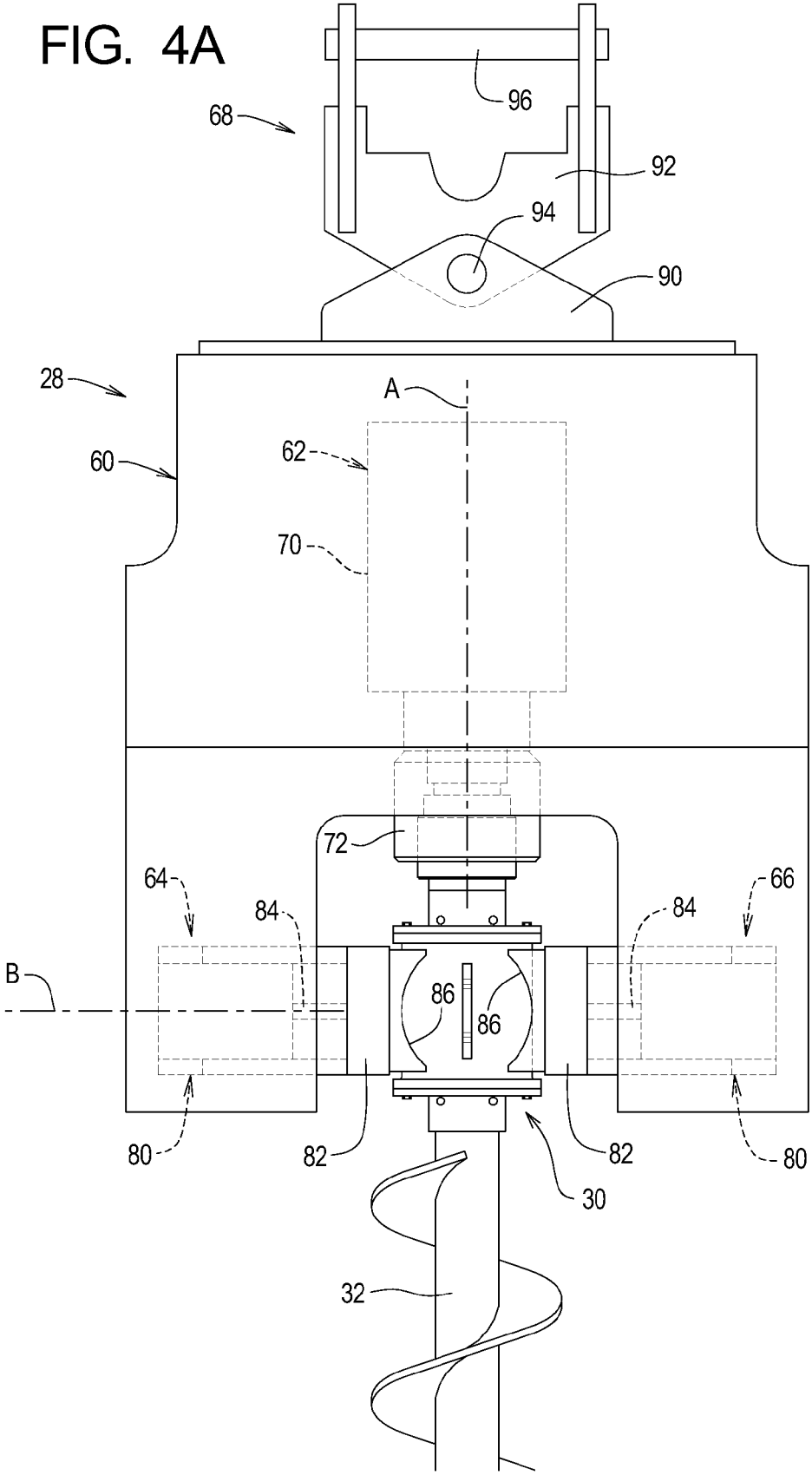
FIG. 4A is a front elevation view of an example accessory connection system connected between the rotational drive system and a drive accessory, with the rotational drive system being depicted in the clamped configuration.
Figure 4B:
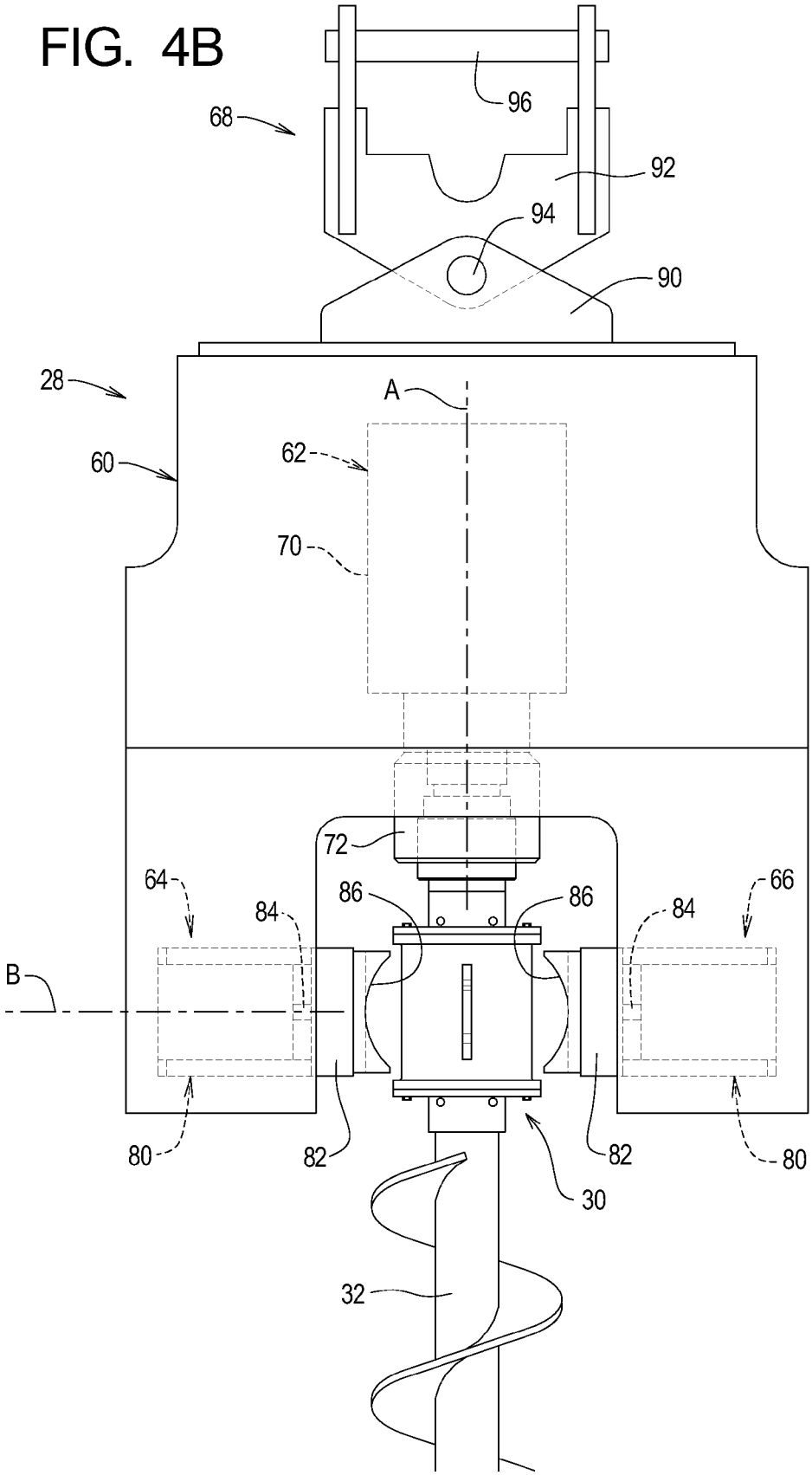
FIG. 4B is a front elevation view of the example accessory connection system connected between the rotational drive system and the drive accessory, with the rotational drive system being depicted in the unclamped configuration.

FIGS. 1A, 3A, and 3B depict an example helical pile driving system 20 for driving helical piles 22 into the earth 24. The helical pile driving system 20 comprises a support system 26 and a rotational drive system 28 connected to the support system 26. The example support system 26 is or may be formed by a conventional excavator. The example rotational drive system 28 is or may be the HD70 Helical Pile Driver sold by American Piledriving Equipment, Inc., but the principles of the present invention may be applied to other rotational drive systems. The support system 26 and rotational drive system 28 are thus both known in the art and will not be described in detail herein beyond that extent necessary for a complete understanding of the present invention.

FIGS. 4A, 4B, 5, and 6 illustrate an example accessory mounting system 30 and an accessory 32 that may be used with the helical pile driving system 20 to facilitate driving of the helical piles 22 under certain conditions. The accessory 32 may be a device such as an auger, a drill, a downhole hammer, or the like. The example accessory mounting system 30 allows the accessory 32 to be quickly and easily connected to and disconnected from the rotational drive system 28 as will be described in further detail below.

Figure 1B:
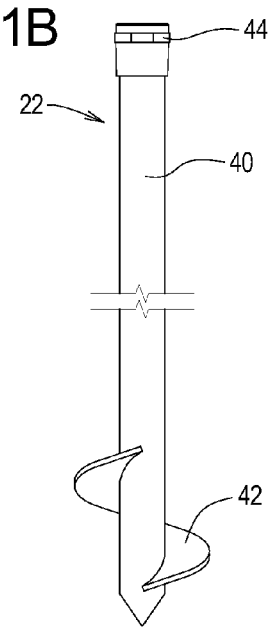
FIG. 1B is side elevation view of the example helical pile being driven in FIG. 1.

As shown in FIG. 1B, the example helical pile 22 comprises a shaft 40, a blade 42, and a drive projection 44. The blade 42 and drive projection 44 are rigidly connected to the shaft 40 such that a rotational force applied to the drive projection 44 is transmitted through the shaft 40 to the blade 42.

In use as shown in FIGS. 1A and 3A, the rotational drive system 28 is detachably attached to the helical pile 22. The support system 26 then supports the rotational drive system 28 such that the helical pile 22 is held in contact with the earth 24. The rotational drive system 28 is then operated such that a rotational force causes axial rotation of the shaft 40 and thus the blade 42. With the blade 42 in contact with the earth 24, the blade 42 will engage the earth such that the shaft 40 is displaced along its axis into the earth 24. However, under some conditions, it may be difficult or impossible for the blade 42 alone to penetrate the earth 24 and thereby drive the helical pile 22 into the earth 24. In these conditions, it may be desirable to form a pilot hole for the helical pile 22 using the accessory 32.

Figure 2A:
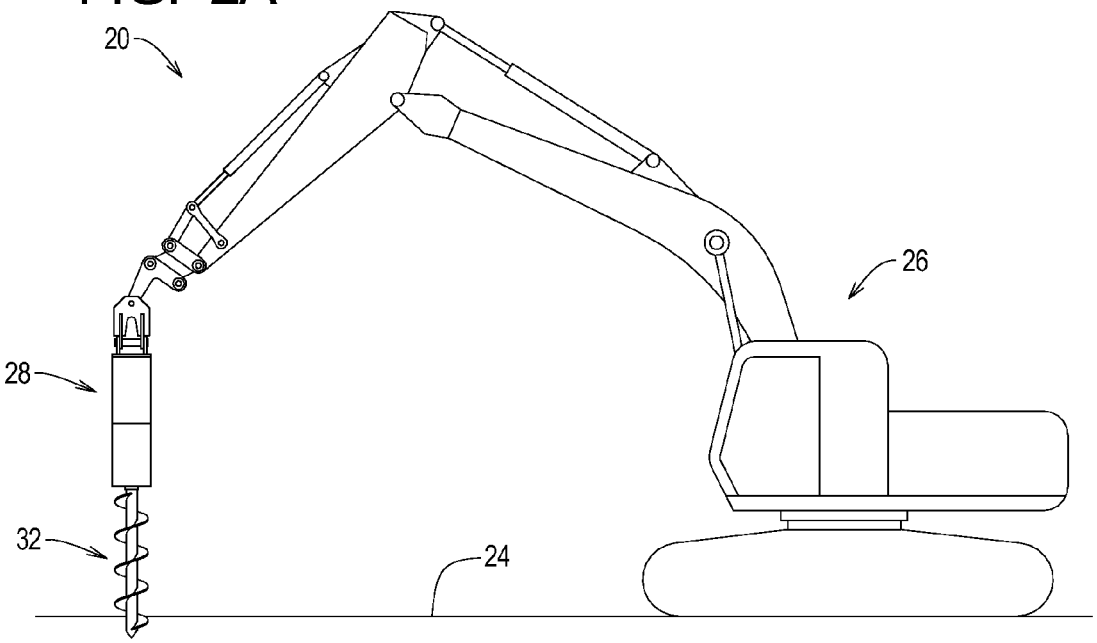
FIG. 2A is a side elevation view of the example helical pile driving system of FIG. 1 using an accessory mounting system of the present invention to use an accessory.
Figure 2B:
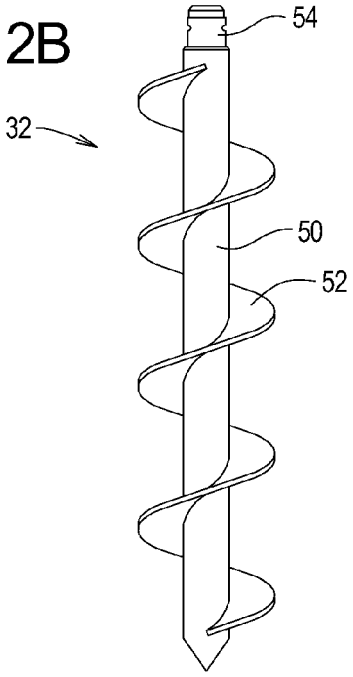
FIG. 2B is side elevation view of the example accessory being used in FIG. 2.

As depicted in FIG. 2B, the example accessory 32 is an auger and comprises an auger shaft 50, an auger blade 52, and an auger male connector 54. The use of the example accessory 32 in the form of an auger to form a pilot hole will be described herein. However, the example accessory mounting system 30 may be configured to allow other types of accessories, such as drills and downhole hammers, and be used for purposes other than rotating a helical pile, including forming a pilot hole in the earth 24 for a helical pile. Accordingly, whenever formation of a hole in the earth is required, the example accessory mounting system 30 allows such holes to be driven with a helical pile driving device such as the example rotational drive system 28, even outside of the context of driving a helical pile.

Turning now to FIGS. 3A, 3B, 4A, and 4B, it can be seen that the example rotational drive system 28 comprises a housing 60, a drive system 62 defining a drive axis A, and first and second clamp systems 64 and 66 defining a clamp axis B. A hitch assembly 68 is formed on the housing 60. The example drive 62 comprises a drive motor 70 and a drive socket 72. The first and second clamp systems 64 and 66 each comprise an actuator 80, a piston member 82, and an actuator shaft 84. A gripping surface 86 is formed on the piston member 82. The hitch assembly 68 comprises a hitch plate 90 rigidly connected to the housing 60, a hitch member 92, and first and second hitch pins 94 and 96. The hitch plate 90 is rigidly connected to the housing 60, and the first hitch pin 94 rotatably attaches the hitch member 92 to the hitch plate 90. The second hitch pin 96 rotatably attaches the hitch member 92 to the support system 26.

During use of the rotational drive system 28, operation of the drive motor 70 causes axial rotation of the drive socket 72 relative to the housing 60. Operation of the actuators 80 causes the piston members 82 to move relative to the housing 60 towards and away from the drive axis A along the piston axis B.

When used to drive the helical piles 22, the rotational drive system 28 is arranged such that the drive projection 44 on a selected pile 22 is adjacent to the drive socket 72. The clamp systems 64 and 66 are then operated to grip the pile 22. The support system 26 may then be operated to lift at least a first or upper end of the pile 22 and move the pile 22 such that a second or lower end of the pile 22 is held at a desired location relative to the earth 24. The piston members 82 axially rotate about the clamp axis B to allow the pile 22 to rotate into a desired angle relative to horizontal as the pile 22 is lifted. At this point, the drive axis A is substantially aligned with the longitudinal axis of the pile 22. The clamp systems 64 and 66 are then operated in the unclamped configurations to allow the drive projection 44 to enter the drive socket 72. The example drive projection 44 and the example drive socket 72 have conforming octagonal shapes such that rotational movement of the drive socket 72 is transferred to the drive projection 44. At this point, the drive motor 70 is operated such that the pile blade 42 engages the earth 24 to drive the pile 22 into the earth 24.

Figure 5:
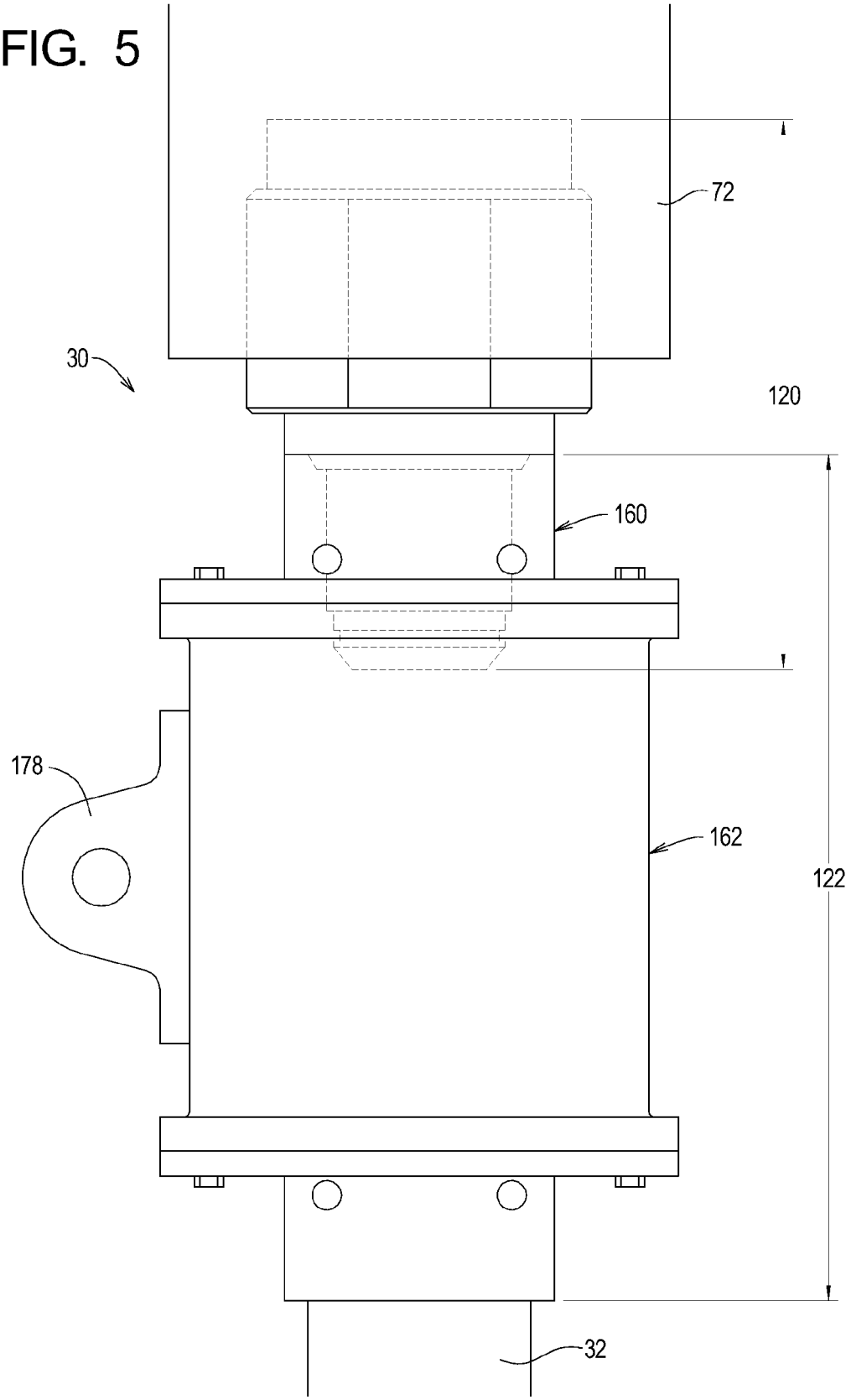
FIG. 5 is an elevation view illustrating the example accessory connection system.
Figure 6:
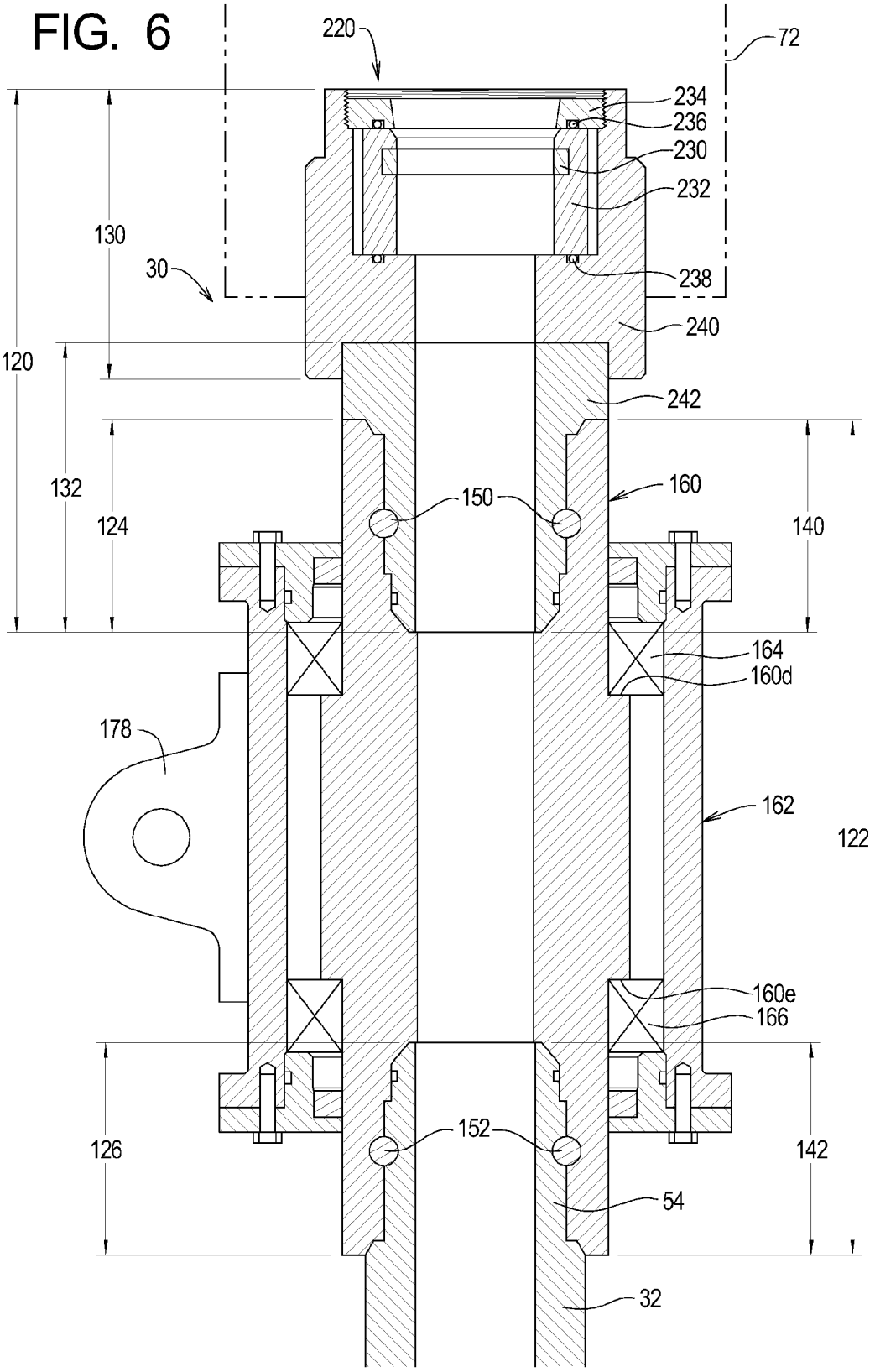
FIG. 6 is a section, elevation view the example accessory connection system.
Figure 7:
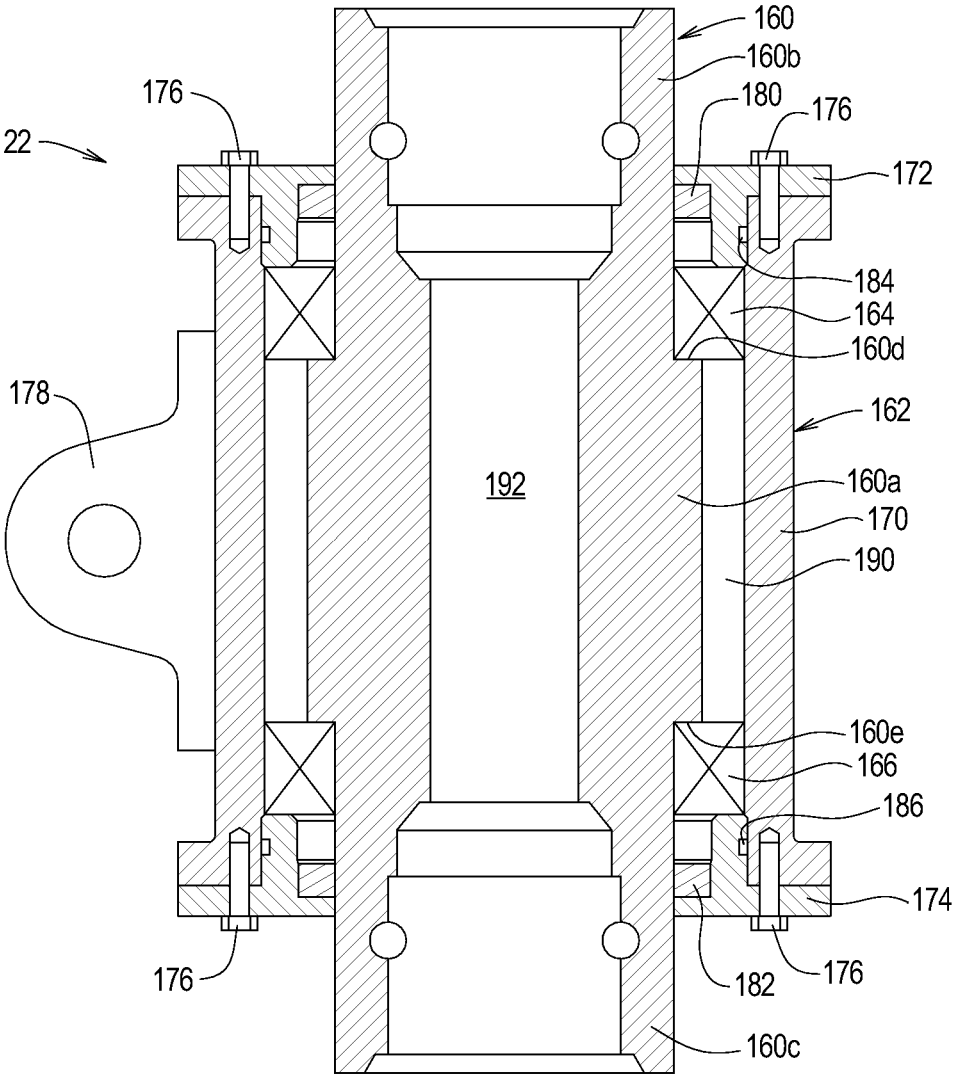
FIG. 7 is a section, elevation view of a swivel assembly of the example accessory connection system.

Turning now to FIGS. 4A, 4B, and 5-9, the example accessory mounting system 30 will be described. The example accessory mounting system 30 comprises an adapter assembly 120 as shown in FIGS. 4A, 4B, 5, 6, 8 and 9 and a swivel assembly 122 as shown in FIGS. 5, 6, and 7. As perhaps best shown in FIG. 6, a first connection system 124 connects the adapter assembly 120 to the swivel assembly 122, and a second connection system 126 connects the swivel assembly 122 to the accessory 32. The first and second connection systems 124 and 126 are or may be industry standard 120 mm Jeffrey couplers or connectors.

In particular, the adapter assembly 120 comprises a drive portion 130 and an adapter male connector 132. The swivel assembly 122 comprises a first female connector 140 and a second female connector 142. The first female connector 140 receives the adapter male connector 132, and adapter connector pins 150 join the adapter assembly 120 to the swivel assembly 122. The second female connector 142 receives the auger male connector 54, and accessory connector pins 152 join the accessory 32 to the swivel assembly 122.

As perhaps best shown in FIG. 7, the swivel assembly 122 comprises a swivel member 160, a swivel housing assembly 162, and first and second bearings 164 and 166. The swivel member 160 comprises a middle portion 160*a* and first and second end portions 160*b* and 160*c*. Bearing surfaces 160*d* and 160*e* are formed at the junctures of the middle portion 160*a* and the first end portion 160*b* and of the middle portion 160*a* and the second end portion 160*c*, respectively. The swivel housing assembly 162 comprises a housing member 170, a first housing cap 172, and a second housing cap 174. Bolts 176 secure the first and second caps 172 and 174 to the housing member 170 to form the swivel housing assembly 162. A swivel tab 178 is rigidly connected to the swivel housing member 170 to facilitate handling of the accessory mounting system 30.

When the swivel assembly 122 is formed, the swivel member 160 is arranged within the swivel housing assembly 162 such that the first bearing 164 is held between the first cap 172 and the first bearing surface 160*d* and the second bearing 166 is held between the second cap and the second bearing surface 160*e*. The bearings 164 and 166 thus allow axial rotation of the swivel member 160 relative to the swivel housing assembly 162.

In addition, the example swivel assembly 122 comprises first and second end seals 180 and 182 and first and second side seals 184 and 186. The first and second end seals 180 and 182 are arranged to form seals between the end caps 172 and 174 and the swivel member 160, respectively. The first and second side seals 184 and 186 are arranged to form seals between the first and second end caps 172 and 174 and the swivel member 160, respectively.

In the example swivel assembly 122, an annular swivel chamber 190 is formed within the swivel housing assembly 162 around the swivel member 160. The swivel chamber 190 may be filed with lubricant such as oil to lubricate the bearings 164 and 166. The swivel member 160 may further define an inner chamber 192 extending between the first and second female connectors 140 and 142. The inner chamber 192 reduces weight of the accessory mounting system 30 and allows fluid to flow through the accessory mounting system 30 as will be described in further detail below.

When required, the accessory mounting system 30 may be used to attach the accessory 32 to the rotational drive system 28 as shown in FIGS. 4A, 4B, 5, and 6. With the accessory 32 joined to the accessory mounting system 30 using the first connection system 124, the rotational drive system 28 is arranged such that the drive portion of the adapter assembly 120 is adjacent to the drive socket 72 of the drive system 62. The clamp systems 64 and 66 are then operated to engage the housing member 170 and thus grip the accessory mounting system 30. The support system 26 may then be operated to lift at least a first or upper end of the accessory mounting system 30 and accessory 32 attached thereto and move the accessory mounting system 30 and accessory 32 such that a second or lower end of the accessory 32 is held at a desired location relative to the earth 24. The piston members 82 axially rotate about the clamp axis B to allow the accessory 32 to rotate into a desired angle relative to horizontal as the accessory 32 is lifted. At this point, the drive axis A is substantially aligned with the longitudinal axis of the accessory 32.

The clamp systems 64 and 66 are then operated in the unclamped configurations to allow the drive portion 130 to enter the drive socket 72. The example drive portion 130 and the example drive socket 72 have conforming octagonal shapes such that rotational movement of the drive socket 72 is transferred to the drive portion 130. At this point, the clamp systems 64 and 66 are operated to prevent relative movement of the accessory mounting system 30 relative to the housing 60 and stabilize the accessory 32 relative to the housing 60. The drive motor 70 may then be operated such that auger blade 52 of the example accessory 32 drills a pilot hole for a helical pile 22. As generally described above, other accessories may be rotated using the accessory mounting system 30 in a similar manner.

After one or more pilot holes are drilled, the accessory mounting system 30 and accessory 32 may be quickly and easily detached from the rotational drive system 28, and helical piles 22 may be lifted and driven with the assistance of the previously driven pilot hole or holes.

Figure 9:
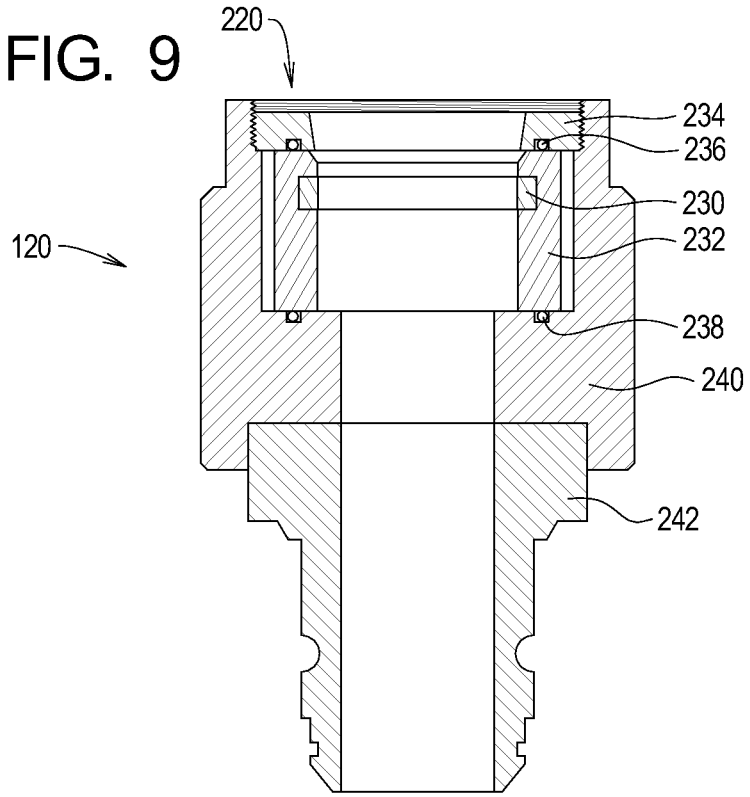
FIG. 9 is a section, elevation view of the first example adapter assembly.

As mentioned above, the inner chamber 192 allows fluid to flow between the first and second female connectors. The American Piledriving Equipment HD70 rotational drive system allows the helical pile 22 to be filled with grout as the pile 22 is being driven as described herein. Other fluids such as water, drilling fluids, and/or air may be pumped through the inner chamber 192 and the accessory 32 to facilitate operation of the accessory 32. In this case, a seal assembly 220 may be formed within the drive portion 130 of the adapter assembly 120 as shown in FIGS. 6 and 9. The example seal assembly 220 comprises a seal member 230, a seal ring 232, a retaining ring 234, a first gasket 236, and a second gasket 238. This seal assembly 220 cooperates with the drive socket 72 of the rotational drive system 28 to allow pressurized fluid to flow through the inner chamber 192.

FIGS. 6 and 9 further show that the example adapter assembly 120 is formed by a first member 240 and a second member 242. These example first and second members 240 and 242 are welded together, but any configuration that forms a rigid structure that is fluid tight and rigidly transfers rotational forces applied to the first member 240 to the second member 242 may be used.

As described above, the drive socket 72 has an octagonal shape to transfer rotational movement generated by the drive motor 72 to the drive projection 44 of the pile 22 in one configuration and to the drive portion 130 of the adapter assembly 120 in another configuration. However, the dimensions of the drive socket 72 will vary depending upon such factors as the specifications of helical piles being driven for a particular job.

Figure 8:
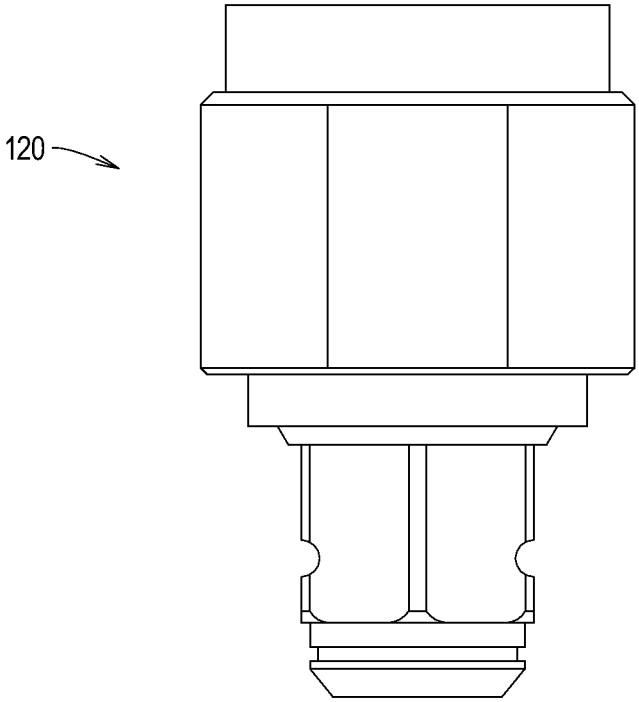
FIG. 8 is an elevation view of a first example adapter assembly of the example accessory connection system.
Figure 10:
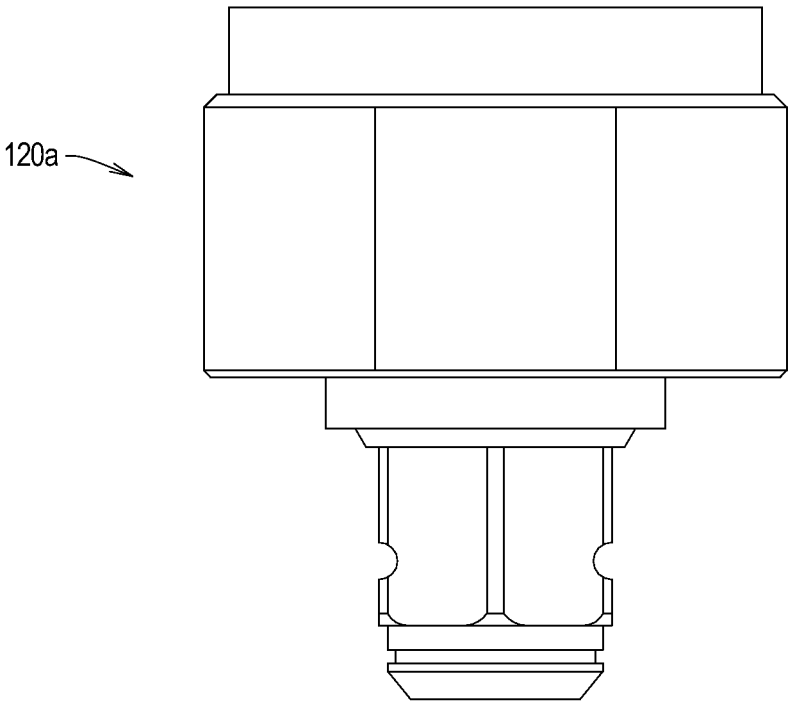
FIG. 10 is an elevation view of a second example adapter assembly of the example accessory connection system.
Figure 11:
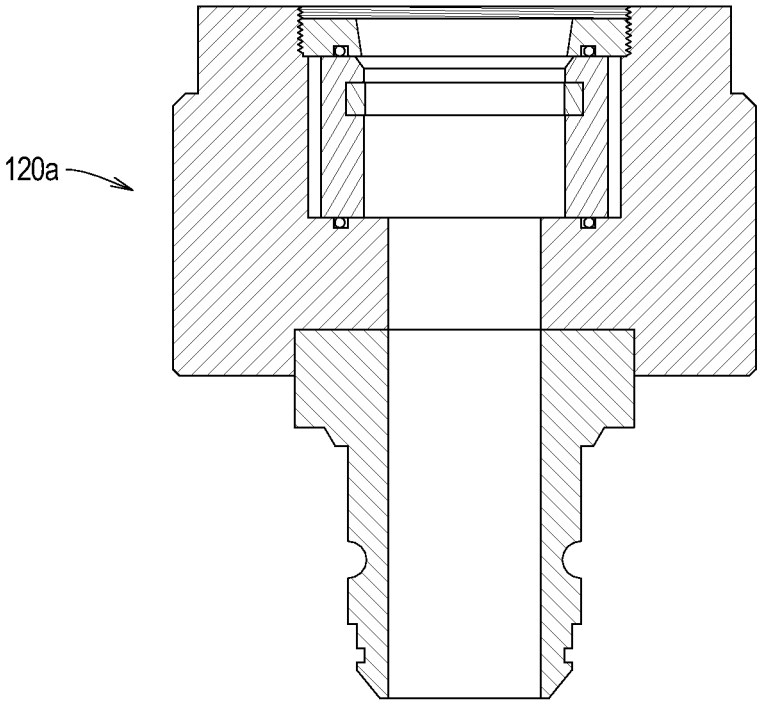
FIG. 11 is a section, elevation view of the second example adapter assembly.
Figure 12:
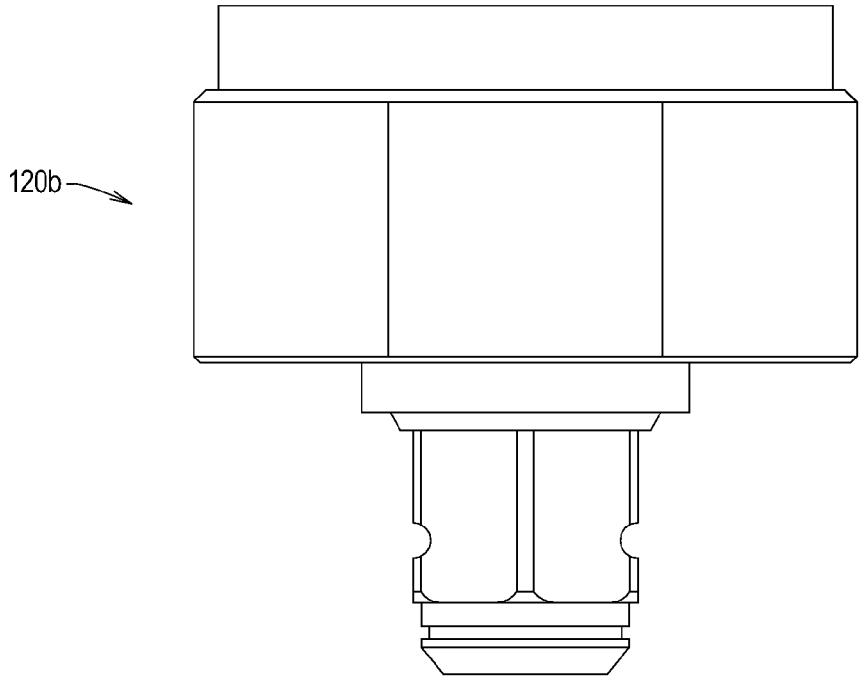
FIG. 12 is an elevation view of a third example adapter assembly of the example accessory connection system.
Figure 13:
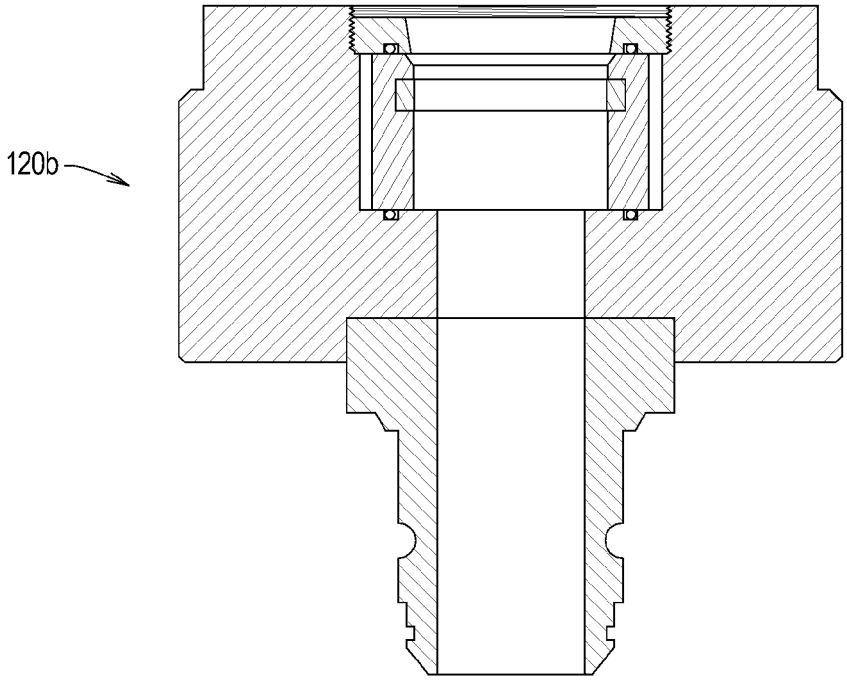
FIG. 13 is a section, elevation view of the third example adapter assembly.

FIGS. 8 and 9 depict an adapter assembly 120 configured to mate with the first example drive socket 72. FIGS. 10 and 11 depict a second adapter assembly 120*a* configured to mate with a second example drive socket that is the same shape as the first example drive socket 72 but is larger in cross-sectional area. FIGS. 12 and 13 depict a third example adapter assembly 120*b* configured to mate with a third example drive socket that is the same shape as the first and example drive sockets but is larger in cross-sectional area than the second example drive socket. The use of multiple adapter assemblies 120, 120*a*, and 120*b* thus allow the accessory mounting system 30 to be easily and quickly modified or adapted to use accommodate drive sockets of different sizes.

Figure 14:
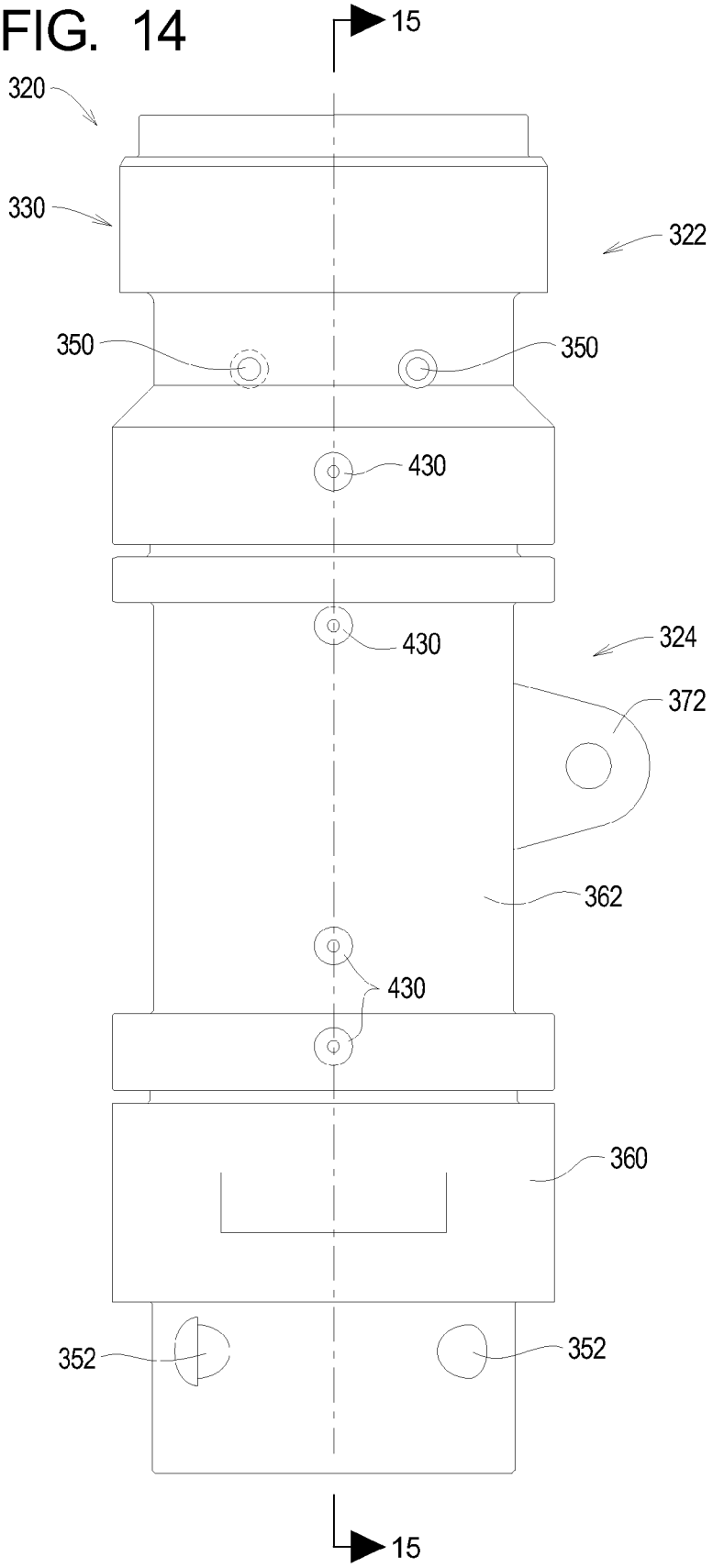
FIG. 14 is a side elevation view of a second accessory mounting system of the present invention.
Figure 15:
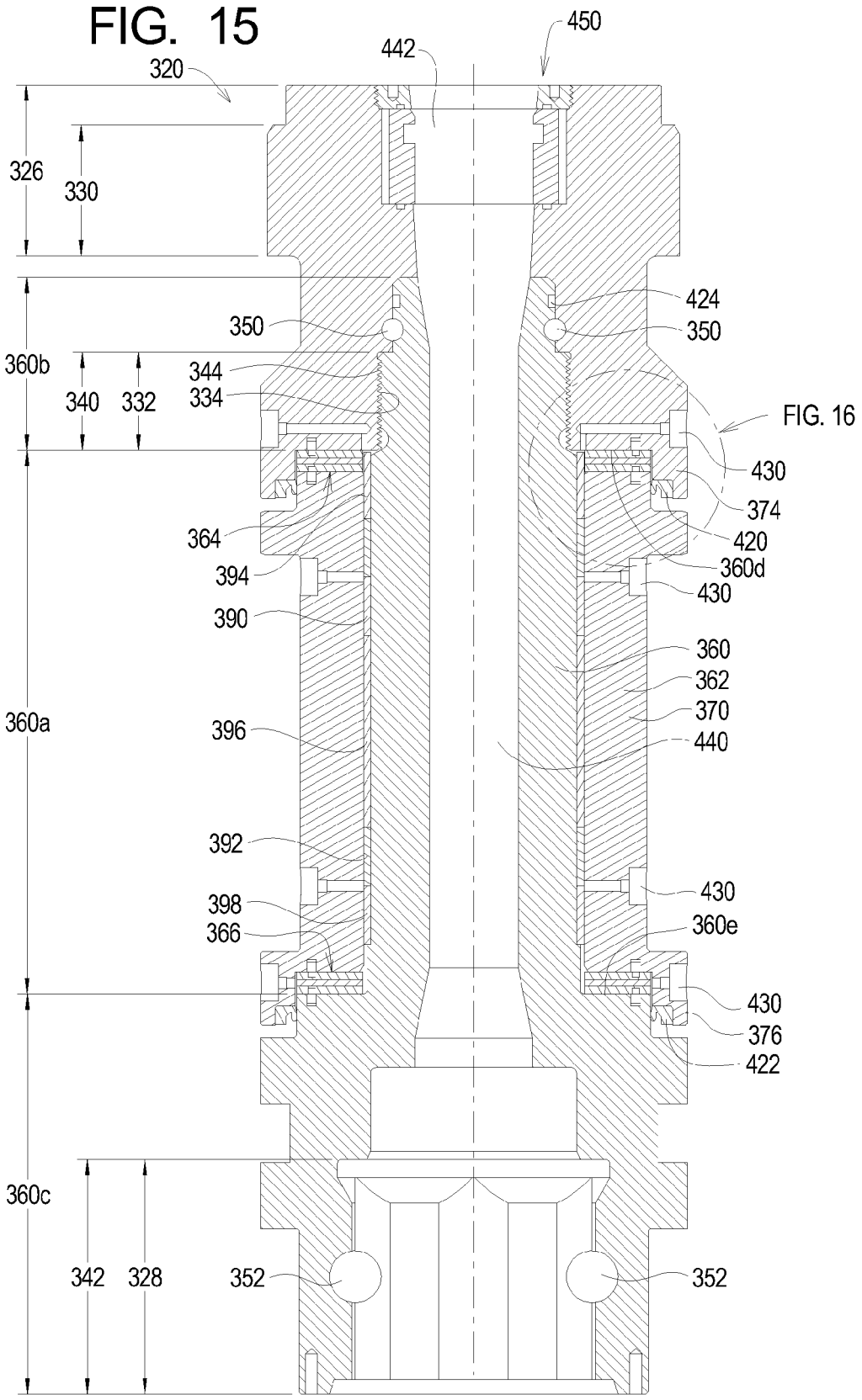
FIG. 15 is section view taken along lines 15-15 in FIG. 14.
Figure 16:
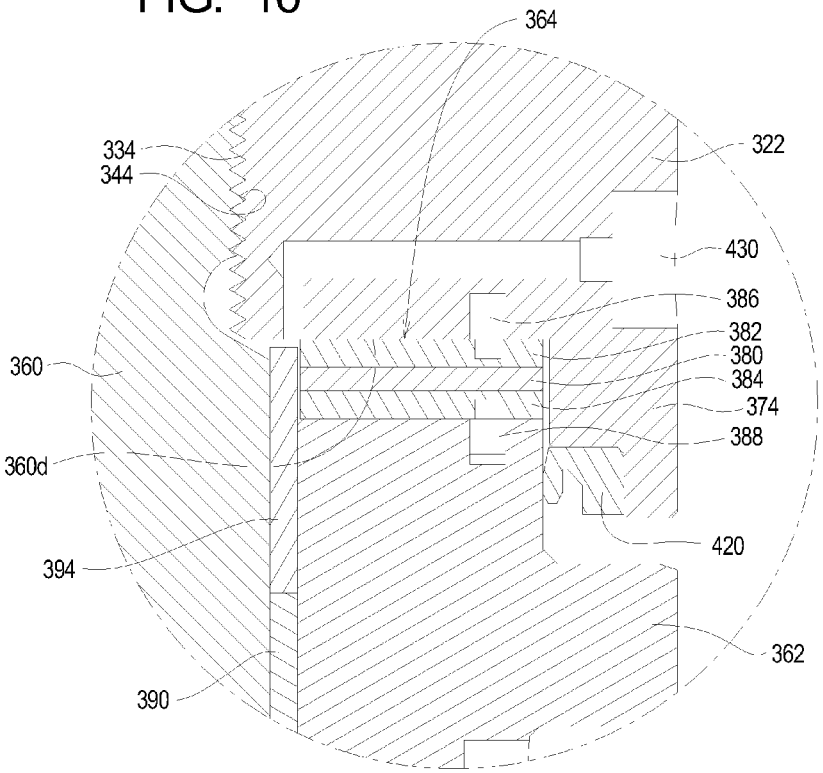
FIG. 16 is an enlarged view of a portion of FIG. 15.

Turning now to FIGS. 14-16, a second example accessory mounting system 320 will be described. The second example accessory mounting system 320 is used, in a manner similar to that of the first example accessory mounting system 30 described above, to connect the rotational drive system 28 to the helical pile 22. The second example accessory mounting system 32 is, however, optimized for use with higher capacity rotational drive systems and larger helical piles.

The second example accessory mounting system 320 comprises an adapter assembly 322 and a swivel assembly 324. A first connection system 326 formed on the adapter assembly 322 connects the accessory mounting system 320 to the drive system 28, and a second connection system 328 formed on the swivel assembly 324 connects the accessory mounting system 320 to the accessory 32. The second connection system 328 is or may be an industry standard Jeffrey coupler or connector or the like.

The example adapter assembly 322 comprises a drive portion 330 and an adapter female connector 332 defining a threaded portion 334. The example swivel assembly 324 comprises a swivel assembly male connector 340 and a swivel assembly female connector 342. The swivel assembly male connector 340 defines a threaded portion 344 that receives the threaded portion 334 of the adapter female connector 332, and adapter connector pins 350 secure the adapter assembly 322 to the swivel assembly 324. The second female connector 342 receives the auger male connector 54, and accessory connector pins 352 join the accessory 32 to the swivel assembly 324.

The example swivel assembly 324 comprises a swivel member 360, a swivel housing 362, and first and second bearings 364 and 366. The swivel member 360 comprises a middle portion 360*a* and first and second end portions 360*b* and 360*c*. Bearing surfaces 360*d* and 360*e* are formed at the junctures of the middle portion 360*a* and the first end portion 360*b* and of the middle portion 360*a* and the second end portion 360*c*, respectively. The swivel housing 362 comprises a housing member 370. A swivel tab 372 (FIG. 14) is rigidly connected to the swivel housing member 370 to facilitate handling of the accessory mounting system 30.

When the swivel assembly 324 is formed, the swivel member 360 is arranged within the swivel housing 362 such that part of the first bearing system 364 is held between the first cap 374 and part of the first bearing surface 360*d* and the second bearing system 366 is held between the second cap 376 and the second bearing surface 360*e*. In particular, the threaded surfaces 334 and 344 engage each other to pull the swivel member 360 towards the adapter assembly 322 such that the swivel member 360 clamps the bearing systems 364 and 366 on either end of the swivel housing 362 as shown in FIG. 15

In particular, as perhaps best shown in FIG. 16, each of the example bearing systems 364 and 366 comprises a thrust bearing 380 arranged between first and second thrust washers 382 and 384. The example thrust bearing 380 is made of aluminum bronze, and the thrust washers 382 and 384 are made of stainless steel. The thrust washers 382 and 384 are pinned to the adapter assembly 322 and the swivel housing 362 by first and second pins 386 and 388, respectively. And as perhaps best shown in FIG. 15, first and second radial bearings 390 and 392 isolate the swivel member 360 from the swivel housing 362 to address radial loads. First, second, and third spacers 394, 396, and 398 maintain the radial bearings 390 and 392 at desired locations along the longitudinal axis of the swivel member 360 during operation of the accessory mounting system 320. The bearing systems 364 and 366 thus allow axial rotation of the swivel member 360 relative to the swivel housing 362.

The second example accessory mounting system 320 further comprises first and second lip seals 420 and 422 and an end seal 424. The first and second lip seals 420 and 422 are arranged to form seals between the end caps 374 and 376 and the swivel member 360, respectively. The end seal 424 is arranged to form a seal between the adapter assembly 322 and the swivel member 360.

In the example swivel assembly 324, a plurality of lubrication ports 430 are formed in the swivel housing 362. The lubricating ports 430 allow the application of lubricant such as oil to lubricate the bearing systems 364 and 366. The swivel member 360 may further define a swivel chamber 440, while the adapter assembly 322 defines an adapter chamber 442. The swivel chamber 440 reduces weight of the accessory mounting system 30 and allows fluid to flow from the adapter chamber 442 and through the accessory mounting system 30 as generally described above.

When required, the second accessory mounting system 320 may be used to attach the accessory 32 to the rotational drive system 28 in the same general manner as the first example accessory mounting system 30 described above. The rotational drive system 28 may then be operated to rotate the accessory 32 using the second accessory mounting system 320 to, for example, drill a pilot hole for a helical pile 22. As generally described above, other accessories may be rotated using accessory mounting system 30 in a similar manner. After one or more pilot holes are drilled, the second example accessory mounting system 320 and the accessory 32 may be quickly and easily detached from the rotational drive system 28, and helical piles 22 may be lifted and driven with the assistance of the previously driven pilot hole or holes.

As mentioned above, the swivel chamber 440 allows fluid to flow through the second example accessory mounting system 320. The American Piledriving Equipment HD70 rotational drive system allows the helical pile 22 to be filled with grout as the pile 22 is being driven as described herein. Other fluids, such as water, drilling fluids, and/or air, may be pumped through the swivel chamber 440 and through, into, or around the accessory 32 to facilitate operation of the accessory 32. In this case, a seal assembly 450 may be formed within the drive portion 330 of the adapter assembly 322 as shown in FIG. 15. This seal assembly 450 cooperates with the drive socket 72 of the rotational drive system 28 to allow pressurized fluid to flow through the swivel chamber 440.

What is claimed is:

1. A mounting system for operatively connecting a helical pile driving system comprising a rotational drive system defining a drive connector and at least one clamp system to a helical pile defining a pile connector and to an accessory defining an accessory connector, the accessory mounting system comprising:

a swivel assembly defining a swivel assembly first connector and a swivel assembly second connector, the swivel assembly comprising a swivel housing, a swivel member a middle portion, where the swivel member comprising is arranged at least partly within the swivel housing such that the middle portion and the swivel housing define a swivel chamber, the swivel assembly first connector extends from an upper end of the middle portion, and the swivel assembly second connector extends from a lower end of the middle portion, and first and second bearings operatively arranged between the swivel member and the swivel housing to support the swivel member for axial rotation relative to the swivel housing; wherein the mounting system operates in a first mode in which the swivel assembly first connector engages the drive connector to connect the swivel member to the rotational drive system;

the swivel assembly second connector engages the accessory connector to connect the swivel member to the accessory;

the at least one clamp system engages the swivel housing such that the clamp system secures the swivel housing to the rotational drive system, and operation of the rotational drive system causes rotation of the accessory; and a second mode in which the pile connector engages the drive connector to connect the helical pile to the rotational drive system, and operation of the rotational drive system causes rotation of the helical pile.

2. A mounting system as recited in claim 1, in which the swivel housing comprises:

a swivel housing member;

a first housing cap secured to the swivel housing member; and a second housing cap secured to the swivel housing member.

3. A mounting system as recited in claim 2, in which:

the swivel housing member defines first and second bearing surfaces;

the first bearing is held against the first bearing surface by the first housing cap; and the second bearing is held against the second bearing surface by the second housing cap.

4. A mounting system as recited in claim 1, in which the swivel member defines an inner chamber extending between the swivel assembly first and second connectors to channel fluid flow from the rotational drive system, through the swivel member, and into one of the helical pile and the accessory connected to the swivel assembly.

5. A mounting system as recited in claim 1, in which the swivel member defines an inner chamber extending between the swivel assembly first and second connectors to allow fluid flow through the swivel member.

6. A mounting system as recited in claim 1, further comprising an adapter assembly defining the swivel assembly first connector.

7. A mounting system as recited in claim 6, in which:

the adapter member defines a first adapter connector; and the swivel member defines a second adapter connector; wherein the first adapter connector engages the second adapter connector to connect the adapter assembly to the swivel member.

8. A mounting system as recited in claim 1, in which:

the mounting system comprises a plurality of different rotational drive systems; and the swivel assembly further comprises a plurality of adapter assemblies, where each adapter assembly is configured to transmit to the swivel member rotational movement of one of the plurality of different rotational drive systems.

9. A mounting system as recited in claim 1, in which the accessory is selected from a group of accessories consisting of an auger, a drill, and a downhole hammer.

10. A method of operatively connecting a helical pile driving system comprising a rotational drive system and at least one clamp system to a helical pile and to an accessory, the method comprising the steps of:

providing a swivel member defining first and second swivel member connector portions;

providing a swivel housing;

providing first and second bearings;

forming a swivel assembly by arranging the first and second bearings between the swivel member and the swivel housing to allow rotation of the swivel member relative to the swivel housing;

operating in a first mode by operatively connecting the swivel member to the drive system using the first swivel member connector portion, operatively connecting the swivel member to the accessory using the second swivel member connector portion, operating the clamp system to secure the swivel housing to the drive system by engaging the swivel housing with the at least one clamp system, and operating the rotational drive system to cause rotation of the accessory; and operating in a second mode by operatively connecting the helical pile to the rotational drive system, and operating the rotational drive system to cause rotation of the helical pile.

11. A method as recited in claim 10, in which the step of forming the swivel assembly further comprises the steps of:

providing an adapter assembly defining an adapter drive connector and an adapter swivel connector;

engaging the adapter swivel connector to the first swivel member connector portion to connect the adapter assembly to the swivel member; and engaging the adapter drive connection to the rotational drive system to operatively connect the adapter assembly to the rotational drive system.

12. A method as recited in claim 11, further comprising the steps of:

providing a plurality of different rotational drive systems;

providing a plurality of different adapter assemblies;

selecting one of the plurality of rotational drive systems;

selecting one of the plurality of different adapter assemblies based on the selected rotational drive system;

connecting the selected adapter assembly to the swivel member; and connecting the selected adapter assembly to the selected rotational drive system.

13. A method as recited in claim 10, in which the step of forming the swivel assembly further comprises the step of forming a swivel chamber between the swivel housing and the swivel member.

14. A method as recited in claim 10, in which the step of providing the swivel member comprises the step of forming an inner chamber in the swivel member that extends between the first and second swivel member connectors to allow fluid flow through the swivel member.

15. A method as recited in claim 10, in which the accessory is one of a group of accessories consisting of an auger, a drill, and a downhole hammer, the method further comprising the step of identifying a selected one of the accessories in the group of accessories.

16. A drive system for driving a helical pile, comprising:

a rotational drive system adapted to drive the helical pile;

at least one clamp system;

at least one accessory; and a swivel assembly comprising a swivel member defining first and second swivel member connector portions, a swivel housing, first and second bearings operatively arranged between the swivel member and the swivel housing to allow rotation of the swivel member relative to the swivel housing, and at least one adapter member defining first and second adapter member connector portions; wherein the first swivel member connector portion is adapted to engage the first adapter member connector portion to operatively connect the swivel member to the adapter member;

the second adapter member connector portion is adapted to engage the rotational drive system to operatively connect the at least one adapter member to the rotational drive system;

the second swivel member connector portion is adapted to engage the at least one accessory to operatively connect the swivel member to the at least one accessory;

wherein the first adapter member connector portion engages the first swivel member connector portion to detachably attach the at least one adapter member to the swivel member;

the second adapter member connector portion engages the rotational drive system to detachably attach the swivel member to the rotational drive system;

the second swivel member connector portion engages the at least one accessory to attach the swivel member to the at least one accessory;

the at least one clamp system engages the swivel housing such that the clamp system secures the swivel housing relative to the rotational drive system, and operation of the rotational drive system causes rotation of the accessory.

17. A drive system as recited in claim 16, in which the accessory is selected from a group of accessories consisting of an auger, a drill, and a downhole hammer.

18. A drive system as recited in claim 16, further comprising:

a plurality of different rotational drive systems; and the swivel assembly further comprises a plurality of adapter assemblies, where each adapter assembly is configured to transmit rotational movement of one of the plurality of different rotational drive systems.

* * * * *